US005586440A

United States Patent [19]

Vincent

[11] Patent Number: 5,586,440

[45] Date of Patent: Dec. 24, 1996

[54] PNEUMATIC REFRIGERATION SYSTEM AND METHOD

[76] Inventor: David M. Vincent, c/o Chester, Willcox & Saxbe 17 S. High St., Suite 900, Columbus, Ohio 43215-3413

[21] Appl. No.: 349,918

[22] Filed: Dec. 6, 1994

[51] Int. Cl.[6] ..... F25B 9/00

[52] U.S. Cl. ..... 62/87; 62/402

[58] Field of Search ..... 62/86, 87, 402

[56] References Cited

U.S. PATENT DOCUMENTS

| | | | |
|---|---|---|---|
| 1,440,000 | 12/1922 | Bonine | 62/402 |
| 3,229,470 | 1/1966 | Cowans | 62/86 |
| 3,528,217 | 9/1970 | Garrett | 55/15 |
| 4,235,079 | 11/1980 | Masser | 62/87 |
| 4,266,408 | 5/1981 | Krause | 62/474 |
| 4,267,701 | 5/1981 | Toscano | 62/86 |
| 4,334,411 | 6/1982 | Payne | 62/86 |
| 4,420,944 | 12/1983 | Dibrell | 62/86 |
| 4,584,838 | 4/1986 | AbuJudom, II | 62/5 |
| 4,655,049 | 4/1987 | Andrews et al. | 62/172 |
| 5,056,335 | 10/1991 | Renninger et al. | 62/402 |
| 5,157,926 | 10/1992 | Guilleminot | 62/24 |
| 5,267,449 | 12/1993 | Kiczek et al. | 62/86 |
| 5,279,130 | 1/1994 | Donaldson | 62/86 |

OTHER PUBLICATIONS

Article, "Local Investors Back 'Revolutionary' Product", The Business Journal, Mid Sep. 1994.

*Primary Examiner*—Ronald C. Capossela
*Attorney, Agent, or Firm*—Biebel & French

[57] ABSTRACT

In one aspect, the invention comprises a pneumatic refrigeration system having a compressor for generating a pressure increase in an air flow, a system expander downstream of the compressor for reducing the temperature of the air flow and a recycling conduit downstream of the system expander for conducting at least a part of the air flow toward the compressor. In another aspect, the invention comprises a method for cooling a refrigerant including the steps of compressing the refrigerant in a compressor, expanding a first portion of the refrigerant, exchanging heat between the first portion of the refrigerant and a second portion of the refrigerant; and expanding the second portion of the refrigerant. One object of the invention is to provide an efficient pneumatic refrigeration system which contains the air flow to reduce the likelihood of contamination by the refrigerated air.

9 Claims, 4 Drawing Sheets

PNEUMATIC REFRIGERATION SYSTEM AND METHOD

BACKGROUND OF THE INVENTION

1. Field of the Invention

This invention relates to the field of refrigeration, and more particularly relates to a pneumatic system which provides efficient cooling without the use of environmentally-harmful refrigerants.

2. Description of the Related Art

A common refrigeration technique is based on the principal that rapidly expanding a pressurized refrigerant gas initially at or near ambient temperature cools the refrigerant. Preferably, the refrigerant gas is expanded sufficiently rapidly to liquify the refrigerant so that the refrigerant absorbs an additional quantity of heat in re-evaporating. One drawback to such systems is that commonly used refrigerants such as fluorocarbons and ammonia are frequently toxic or react to form environmentally-harmful compounds if released or vented to the atmosphere. While environmentally-tolerable refrigerant compounds are available, such compounds tend to be relatively expensive and are often corrosive.

While air is more environmentally-friendly than such commonly-used refrigerants as ammonia and fluorocarbons, it is also less efficient. Indeed, air is a mixture of gases, and certain components such as carbon dioxide have very low boiling points and are difficult to liquefy in cryogenic systems. In addition, the air in a pneumatic refrigeration system may carry biological or chemical contaminants incompatible with sterile environments such as food storage areas. Oil droplets and water vapor entrained or evaporated into the air may collect on the inner surfaces of the system, particularly in cooler sections, and interfere with its operation. Consequently, there exists a need to inhibit airborne contamination from the air flow in a pneumatic refrigeration system and to increase the efficiency of such systems to offset the loss of efficiency inherent in the use of air rather than less environmentally-friendly but more efficient refrigerants.

SUMMARY OF THE INVENTION

This need is addressed by a pneumatic refrigeration system which recycles the refrigerated air to provide precooling for the system. In preferred form, such a system comprises a multistage compressor with intercooling for generating a compressed air flow; a purifier for removing at least one contaminant from the compressed air flow; a precooler; a system expander for expanding the compressed air flow to generate a refrigerated air flow; an output heat exchanger and a mixer for receiving the refrigerated air flow from the output heat exchanger, mixing the refrigerated air flow with a supply of ambient air sufficient to form a mixture having a preselected flow rate, and discharging the mixture to the compressor. The recycling of the air through the mixer increases the efficiency of the system by lowering the initial temperature of the air entering the compressor and thereby reducing the amount of energy required to achieve a desired degree of refrigeration. Indeed, it is anticipated that the efficiency of the system will improve as the system runs, such that the system will approach an equilibrium in which very little ambient make-up air is required. Furthermore, the recycling of the refrigerant air prevents the release of the refrigerant air into sterile environments such as the interiors of food storage units. By containing the refrigerant air flow in this manner, the likelihood of contamination is reduced.

In an especially preferred form, the precooler includes a precooling expander for expanding a portion of the compressed air flow and a precooling heat exchanger for transferring heat from the remainder of the compressed air flow to the expanded portion. The use of a portion of the compressed air to precool the remainder increases the efficiency of the system by either eliminating or reducing the capacity required of external precooling systems such as heat exchangers.

Accordingly, it is one object of the present invention to provide an efficient pneumatic refrigeration system which contains the air flow to reduce the likelihood of contamination by the refrigerated air. This and other objects, features and advantages of the present invention will be described in further detail in connection with preferred embodiments of the invention shown in the accompanying drawings, in which:

DETAILED DESCRIPTION OF THE PREFERRED EMBODIMENT

Figure 1:
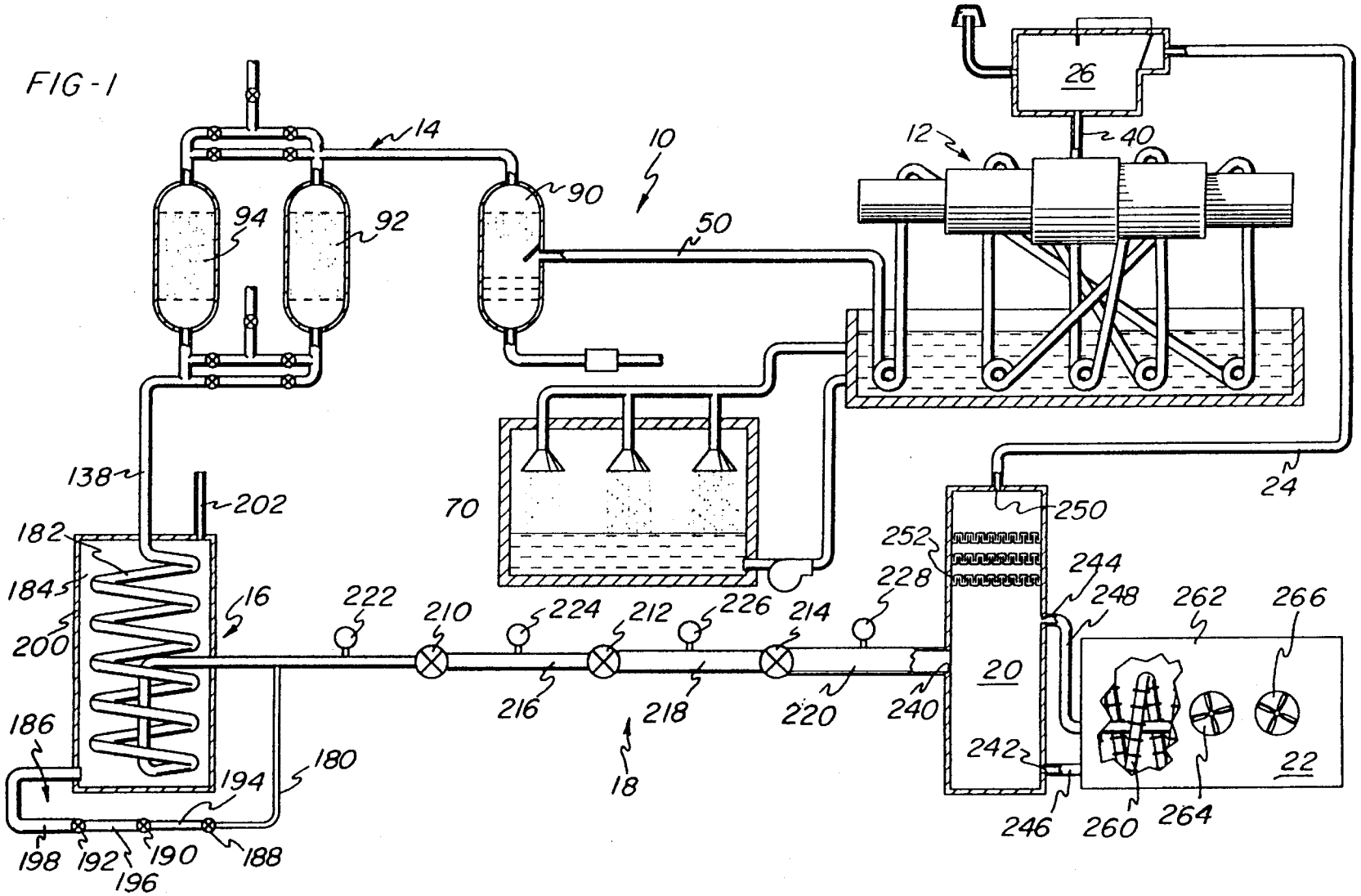
FIG. 1 is a schematic view of a first embodiment of a pneumatic refrigeration system according to the present invention.

FIG. 1 is a schematic view of a first embodiment of a pneumatic refrigeration system 10 according to the present invention. The preferred system 10 includes a multistage compressor 12, a purifier 14, a precooler 16, a system expander 18, an accumulator 20, an output heat exchanger 22, a recycling conduit 24 and a mixer 26. When the system 10 is started up, air is taken in through the mixer 26 and discharged to the compressor 12. The compressor 12 compresses the air to generate a compressed air flow which is discharged to the purifier 14. The purifier 14 receives the compressed air flow from the compressor 12 and removes impurities such as water vapor, oil and carbon dioxide. The precooler 16 receives the compressed air flow from the purifier 14 and cools the air flow prior to receipt by the system expander 18. The system expander 18 receives the air flow from the precooler and expands the air to generate a refrigerated air flow. The refrigerated air flow is received by the accumulator 20 and discharged to the output heat exchanger 22. Once the refrigerated air flow has circulated through the output heat exchanger 22, it returns to the accumulator 20 for discharge to the recycling conduit 24. The recycling conduit 24 conducts the air to the mixer 26, in which the refrigerated air is combined with a supply of ambient air sufficient to form a mixture having a preselected flow rate prior to discharge back into the compressor 12.

Figure 2:
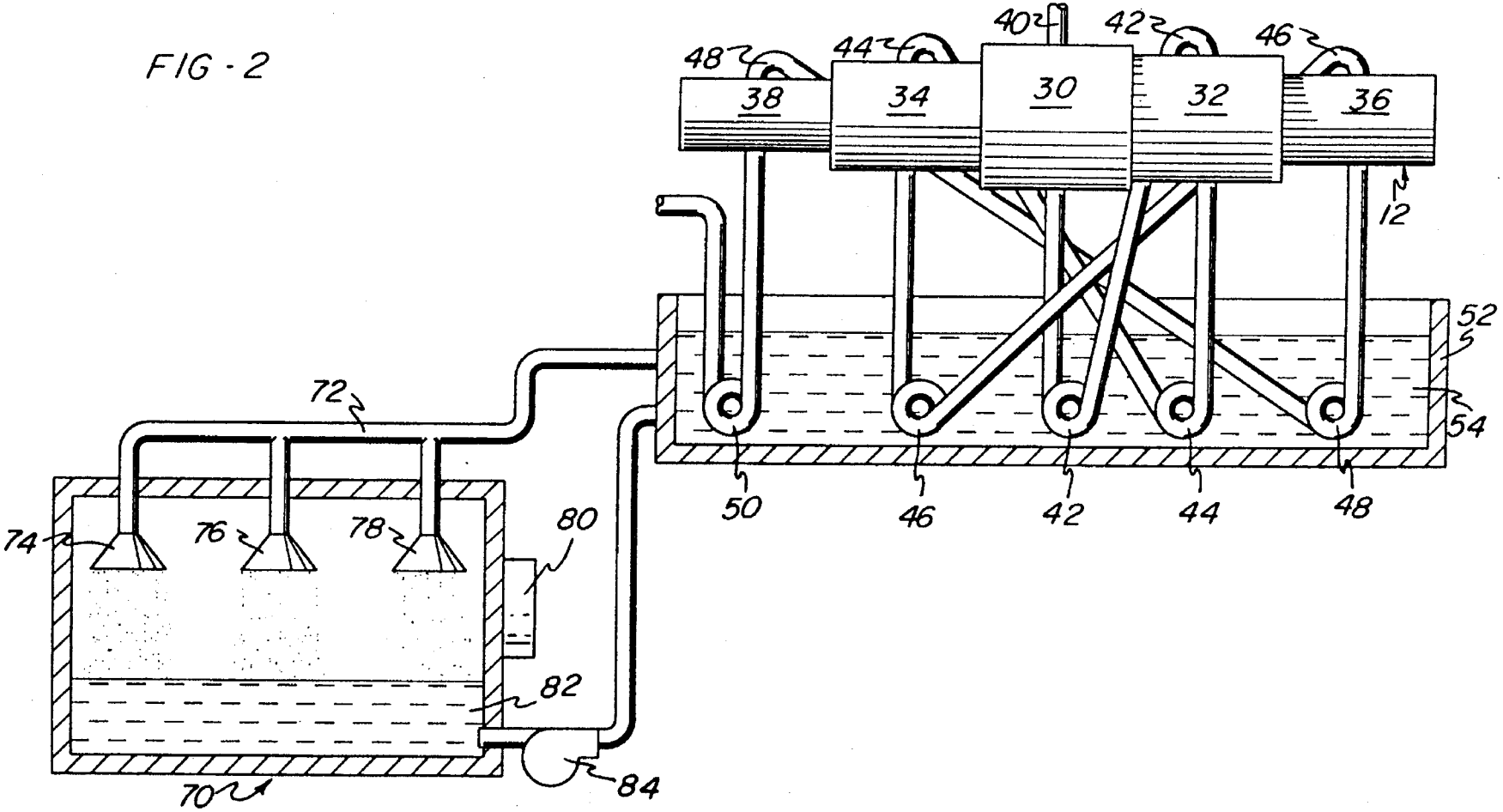
FIG. 2 is a schematic view of a multistage compressor with intercooling for the pneumatic refrigeration system of FIG. 1.

FIG. 2 is a schematic view of the multistage compressor 12. The compressor 12 includes five compressor stages 30, 32, 34, 36 and 38 arranged serially to compress the air flow received from the mixer 26 (FIG. 1) in steps. (The number or arrangement of the compressor stages is not critical to the invention.) The multistage compressor 12 includes a inlet conduit 40 for conducting the air flow from the mixer 26 (FIG. 1 ); intermediate conduits 42, 44, 46 and 48 for conducting the air flow between the stages 30, 32, 34, 36 and 38; and an outlet conduit 50 for conducting the compressed air flow to the purifier 14.

The air flow passing through the conduits 42, 44, 46, 48 and 50 is cooled in a water tank 52 containing a circulating water bath 54. The water tank 52 may be either continuous or divided into sections each dedicated to one of the conduits 42, 44, 46, 48 and 50. In a particularly preferred form, the conduits 42, 44, 46, 48 and 50 are coiled or otherwise curved to increase the length, and hence the surface area, of the conduits 42, 44, 46, 48 and 50 in the circulating water bath 54. Condensate drains (not shown) are provided near the lowest point in each of the conduits 42, 44, 46, 48 and 50 to drain condensate which forms as the air flow is cooled by heat exchange with the circulating water bath 54.

The heat transferred from the conduits 42, 44, 46, 48 and 50 to the circulating water bath 54 is dissipated by circulating the water through an evaporative cooling tower 70. Water drawn from the circulating water bath 54 is conducted to a cooling tower manifold 72, which distributes the water to a series of showers 74, 76 and 78. (While three showers 74, 76 and 78 are shown, the number is not critical to the operation of the invention.) The showers 74, 76 and 78 release the water in thin jets or sprays into an air stream generated by a fan 80. The thin jets or sprays of water transfer heat to the air stream before entering a pool 82 from whence the water is returned to the circulating water bath 54. A pump 84 is provided to drive the circulation of the water between the water tank 52 and the evaporative cooling tower 70.

Figure 3:
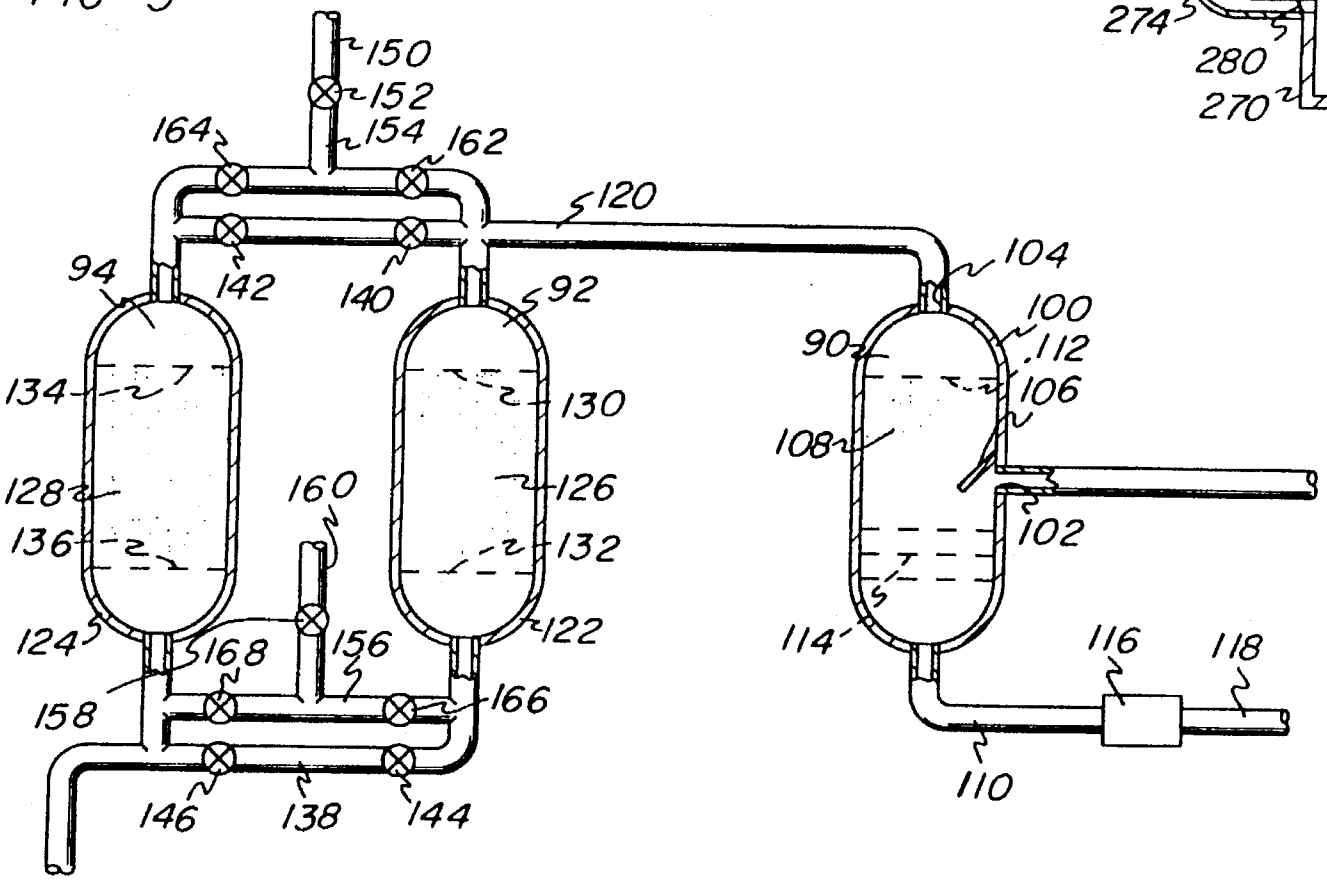
FIG. 3 is a schematic view of a purifier for the pneumatic refrigeration system of FIG. 1.

As shown in FIG. 1, the compressed air flow generated by the multistage compressor 12 is discharged through the outlet conduit 50 and received by the purifier 14, which removes impurities such as water vapor, oil and carbon dioxide from the air flow. As shown in FIG. 3, the purifier 14 includes an oil scrubber 90 in series with two alternating adsorption separators 92 and 94. In this embodiment, the oil scrubber 90 is adapted to remove oil and water entrained in the compressed air flow while the adsorption separators 92 and 94 are adapted to remove gaseous impurities such as carbon dioxide and water vapor which failed to condense in the oil scrubber 90.

The oil scrubber 90 includes an oil scrubber tank 100 which receives the compressed air flow through a side port 102 and discharges the compressed air flow through an upper port 104. Preferably, a solid baffle 106 angled inwardly and downwardly is positioned adjacent the side port 102 to deflect the compressed air flow downwardly as it enters the oil scrubber tank 100. A filter 108 comprising a granular material such as stainless steel shavings is positioned above the side port 102 to nucleate droplets of water and oil which fall toward the bottom of the oil scrubber tank 100 and exit through an oil recovery conduit 110. A perforated plate 112 is positioned above the filter 102 to inhibit the granular material from leaving the oil scrubber tank 100 with the compressed air flow, while a series of perforated baffles 114 are positioned near the bottom of the oil scrubber tank 100 to inhibit the granular material from exiting with the oil and water through the oil recovery conduit 110.

The oil recovery conduit 110 leads to a trap assembly 116 which includes a float valve (not shown) for separating the oil and water which drip down from the filter 108. The oil, which is heavier than the water, exits the trap assembly 116 downwardly through an oil return conduit (not shown), while the water is disposed of laterally through a water disposal conduit 118. The float valve (not shown) serves to determine that there is sufficient oil in the trap 110 to cover the port (not shown) leading to the oil return conduit (not shown) before the port is opened, so that water is prevented from entering the oil return conduit (not shown) and reaching the compressor 12.

The compressed air flow discharged from the oil scrubber 90 is received through a compressed air inflow manifold 120 into one of the adsorption separators 92 and 94, where gaseous impurities such as water vapor and carbon dioxide are removed. The two adsorption separators 92 and 94 are identical in construction, each of the adsorption separators 92 and 94 comprising a separator tank 122, 124 which confines a filter 126, 128 composed of molecular sieve material between perforated plates 130, 132, 134 and 136. The gaseous impurities are adsorbed by the molecular sieve material as the compressed air flow passes from the compressed air inflow manifold 120 through one of the filters 126, 128 to a compressed air outflow manifold 138.

Since the filters 126 and 128 adsorb gaseous impurities from the compressed air flow, the filters 126 and 128 must be periodically "re-activated" by passing a warm, dry flush gas such as air or nitrogen through the adsorption separators 92 and 94 to remove the adsorbed impurities. In order to avoid down-time during the re-activation of the filters 126 and 128, compressed air inflow valves 140 and 142 are positioned in the compressed air inflow manifold 120 and compressed air outflow valves 144 and 146 are positioned in the compressed air outflow manifold 138 so that the compressed air flow alternates between the two adsorption separators 92 and 94. While the compressed air flow from the compressor 12 is directed through one of the adsorption separators 92 and 94, flush gas is directed through the other.

A system of conduits parallel to the compressed air inflow and outflow manifolds 120 and 138 direct the flush gas through the adsorption separators 92 and 94. The flush gas passes from a flush gas supply conduit 150 through a flush gas supply valve 152 to a flush gas supply manifold 154, which distributes the flush gas to the adsorption separators 92 and 94. The flush gas exiting the adsorption separators 92 and 94 is gathered by a flush gas exhaust manifold 156 and passes through a flush gas exhaust valve 158 to a flush gas exhaust conduit 160. Flush gas inflow valves 162 and 164 are positioned in the flush gas inflow manifold 154 and flush gas outflow valves 166 and 168 are positioned in the flush gas outflow manifold 156 so that the flush gas is directed at all times to the adsorption separator 92, 94 opposite that through which the compressed air flow is directed. The valves 140, 142, 144, 146, 162, 164, 166 and 168 may be actuated either manually or by a controller, such as an electronic or pneumatic controller (not shown), so that the compressed air flow and flush gas are alternately directed through each of the adsorption separators 92 and 94.

Returning to FIG. 1, the compressed air flow exiting the purifier through the compressed air outflow manifold 138 is received by the precooler 16, which cools the gas prior to expansion in the system expander 18. The precooler 18 includes a precooling heat exchanger 184 having a precooling heat exchange conduit 182 and a precooling heat exchanger shell 200. The precooling heat exchange conduit 182 conducts the compressed air flow along a path through the precooling heat exchanger 184. As the compressed air flow emerges from the precooling heat exchanger 184, a portion of the compressed air flow is tapped off through a tap line 180.

The portion of the compressed air flow which enters the tap line 180 passes through a precooling heat expander 186 comprising series of expansion needle valves 188, 190 and 192. As this portion of the compressed air flow passes through the expansion valves 188, 190 and 192, it rapidly expands into successively wider conduits 194, 196 and 198 and cools to a temperature below that of the remainder of the compressed air flow. This cooled air then passes through the precooling heat exchanger shell 200 and flows around the precooling heat exchange conduit 182 to cool the remainder of the compressed air flow. The expanded portion of the compressed air flow is then recycled to the mixer 26 through a venting conduit 202 or, alternatively, vented to the atmosphere.

The remainder of the compressed air flow exiting the precooler 16 is received by the system expander 18, which expands the air to generate a refrigerated air flow. The system expander as shown comprises a series of three expansion needle valves 210, 212 and 214, though the number is not critical to the invention. As the air flow passes through the expansion needle valves 210, 212 and 214, it rapidly expands into successively wider conduits 216, 218 and 220 and cools to a temperature below ambient. In an especially preferred embodiment, gauges 222, 224, 226 and 228 are provided before, between and behind the expansion needle valves 210, 212 and 214 to monitor the pressure or temperature in the system expander 18.

The refrigerated air flow exiting the system expander 18 is received by the accumulator 20 through an expander intake port 240 in a lower side wall of the accumulator 20 for circulation through the output heat exchanger 22. Preferably, the accumulator 20 is in the form of a vertically elongated stack to separate warmer from cooler air by gravity. In addition to the port 240, the accumulator 20 includes heat exchanger intake and outlet ports 242 and 244 in the side wall of the accumulator 20 which communicate through heat exchanger intake and outlet conduits 246 and 248 with the output heat exchanger 22. The accumulator 20 also includes a recycling conduit outlet port 250 in an upper portion of the leading to the recycling conduit 24. In an especially preferred form, the accumulator 20 includes a series of bubble trays 252 interposed between the inlet ports, 240 and 244, and the recycling conduit outlet port 250 to prevent liquids such as water droplets and liquified air components from entering the recycling conduit 24. In order that the output heat exchanger 22 operate at maximum efficiency, the output heat exchanger 22 is preferably located at least six feet below the midsection of the accumulator 20.

The refrigerated air flow circulates from the accumulator 20 through an output heat exchange conduit 260 in the output heat exchanger 22 to cool an air blast which flows around the output heat exchange conduit 260 within an output heat exchanger shell 262. In a particularly preferred form, the output heat exchange conduit 260 is coiled or otherwise curved and finned to increase its length and surface area exposed to the air blast. The output heat exchanger shell 262 mounts a plurality of fans (only two, 264 and 266, shown) which drive the air blast around the output heat exchange conduit and out from the output heat exchange shell 262 toward the heat source to be cooled. By utilizing heat exchange with a air blast in this manner, the air blast may be isolated from the refrigerated air flow to inhibit contamination by either the refrigerated air flow or the atmosphere.

Once the refrigerated air flow has passed through the output heat exchanger 22 and returns to the accumulator 20, it is warmer than the air arriving directly from the system expander 18 and rises toward the recycling conduit outlet port 250. This warmer air is received through the port 250 into the recycling conduit 24, which conducts the refrigerated air flow to the mixer 26 for reuse.

Figure 4:
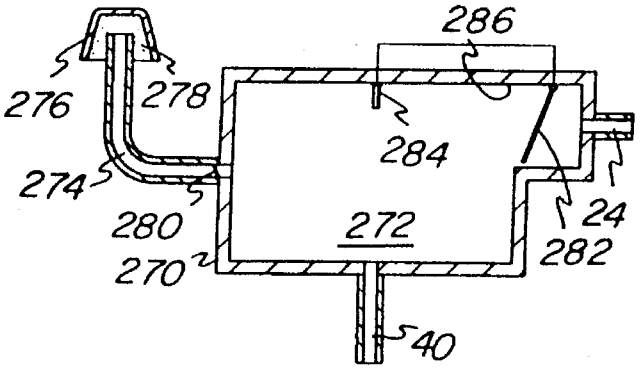
FIG. 4 is a schematic view of an air intake and mixer for the pneumatic refrigeration system of FIG. 1.

As shown in FIG. 4, the mixer 26 receives both the refrigerated air flow from the recycling conduit 24 and a supply of ambient air sufficient to form a mixture having a preselected flow rate through the conduit 40 into the multistage compressor 12. The mixer 26 includes a mixing chamber shell 270 defining a mixing chamber 272 which receives the refrigerated air flow from the recycling conduit 24. The mixer 26 also includes an ambient air intake conduit 274 which conducts ambient air into the mixing chamber 272, where the supply of ambient air and the refrigerated air flow mix. A cap 276 is positioned over the intake end of the ambient air intake conduit 274 to prevent solid objects from entering and clogging the conduit 274. A desiccant material 278 is positioned in the cap 276 to remove moisture from the ambient air entering the system.

In an especially preferred form, the mixture of air in the mixer 26 is controlled by a pressure-sensitive valve 280 positioned in the ambient air intake conduit 274 and a thermally-sensitive valve 282 which controls the air flow from the recycling conduit 24. The pressure-sensitive valve 280 serves to ensure that the supply of ambient air is sufficient so that the mixture of the refrigerated air flow and the ambient air has the preselected flow rate through the conduit 40. The thermally-sensitive valve 282 controls the intake of the refrigerated air flow into the mixer 26 so that the temperature of the mixture received by the compressor 12 from the mixer 26 does not fall below approximately 0° F. Below this temperature, the air might cool the oil in the compressor 12 to the point where the oil gels and fouls the compressor 12. The thermally-sensitive valve 284 is controlled electronically in response to a thermal sensor 284 which measures the temperature of the air mixture in the mixing chamber 272. The valve 284 is a flapper which pivots between a port 286 into the mixer 26 and a vent 288 to the atmosphere to control the volume of the refrigerated air flow which enters the mixer 26 and vent the remainder.

By recycling the refrigerated air flow to the compressor, the efficiency of the system is increased since the refrigerated air flow provides initial precooling prior to compression. Furthermore, the recycling of the refrigerated air flow reduces the amount of ambient air required by the system 10, thereby reducing the risk of contamination or obstruction of the system 10 by airborne contaminants. It is anticipated that, after perhaps a few hours of operation, the system will operate primarily on recycled air and require very little make-up air.

Figure 5:
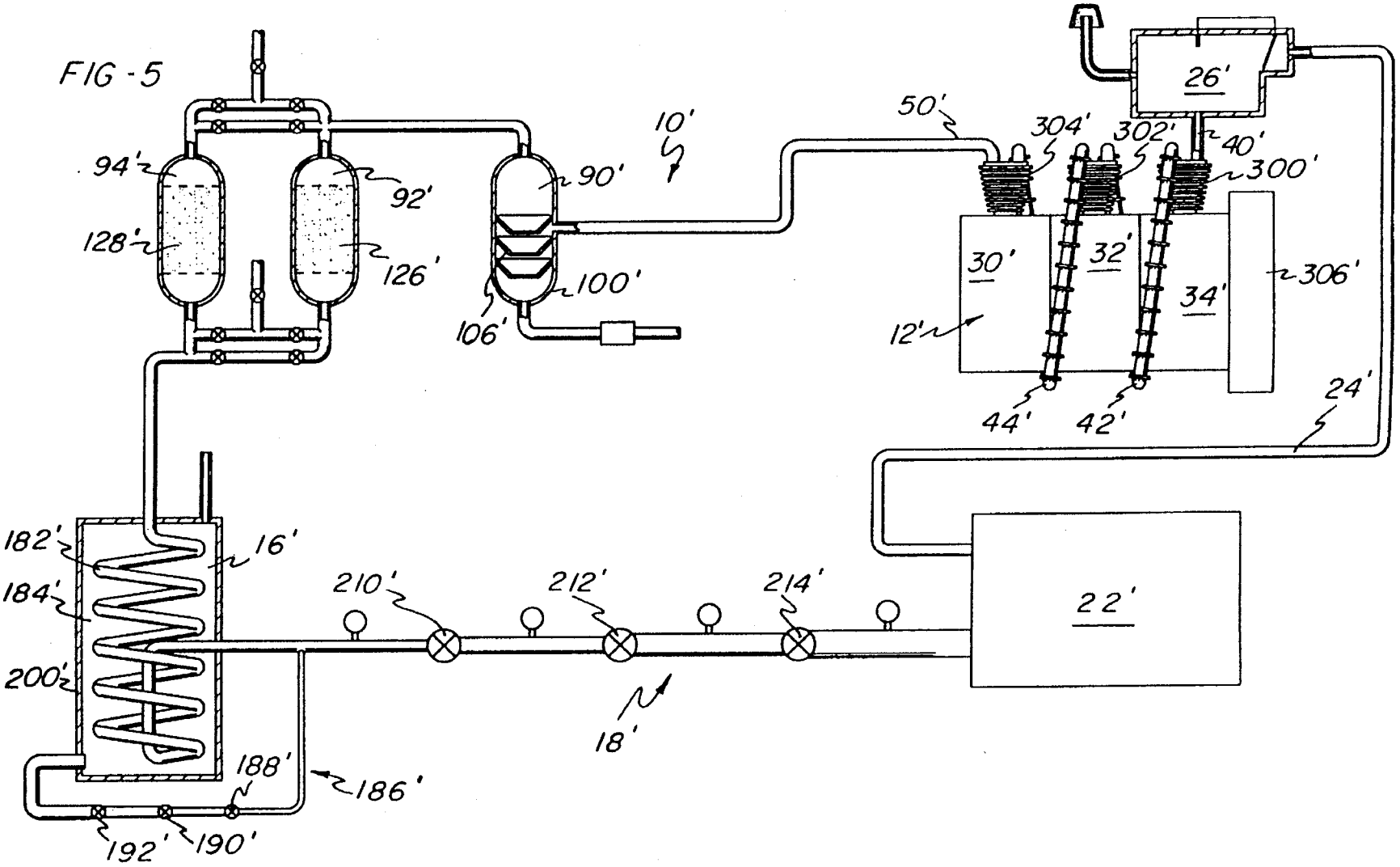
FIG. 5 is a schematic view of a second embodiment of a pneumatic refrigeration system according to the present invention.

A portable refrigeration system 10' embodying the present invention is shown schematically in FIG. 5. The system 10' operates on the same principals as the industrial system 10 of FIG. 1, and the same reference numerals will be used for analogous parts of the systems 10 and 10', distinguished by the use of the prime "'" symbol. Like the system 10, the refrigeration system 10' comprises a multistage compressor 12', a purifier 14', a precooler 16', a system expander 18', a heat exchanger 22', a recycling conduit 24' and a mixer 26'. Since the portable system 10' is not designed to achieve cryogenic temperatures, it does not include an accumulator analogous to the accumulator 20 of FIG. 1.

The compressor 12' includes three compressor stages 30', 32' and 34' arranged serially to compress the air flow received from the mixer 26' (FIG. 1) in steps. (As mentioned previously, the number and arrangement of the stages is not critical to the invention.) Compressor stages useful in connection with the invention include reciprocating compressors such as Type 30 high-pressure air-cooled compressors manufactured by Ingersoll-Rand Co. The multistage compressor 12' includes a inlet conduit 40' for conducting the air flow from the mixer 26' (FIG. 1 ); intermediate conduits 42' and 44' for conducting the air flow between the stages 30', 32' and 34'; and an outlet conduit 50' for conducting the compressed air flow to the purifier 14'. The conduits 42', 44' and 50' are finned and communicate with the compressor stages 30', 32' and 34' through finned jugs 300', 302' and 304' to dissipate heat between the compressor stages 30', 32' and 34'. A fan 306' provides a stream of air across the finned conduits 42', 44' and 50' and the finned jugs 300', 302' and 304' to cool the air flow between the compressor stages 30', 32' and 34'. In an especially preferred embodiment, the compressor stages, 30', 32' and 34', and the fan 306' are operated by a common motor and belt (not shown).

Since the portable system 10' is not designed to achieve cryogenic temperatures, the purifier 14' need not be designed to remove carbon dioxide. Instead, in the embodiment shown in FIG. 5, the purifier 14' includes an oil scrubber 90' and two separators 92' and 94' each containing a desiccant material 126', 128' which need not be a molecular sieve material. As with the adsorption separators 92 and 94 of FIGS. 1 and 3, provision is made to re-activate the desiccant material 126' and 128' by flushing the desiccant material 126', 128' with a warm, dry flush gas such as nitrogen or air. Unlike the oil scrubber 90 of the industrial system 10, the oil scrubber 90' of the embodiment 10' comprises a tank 100' with a series of downwardly-angled baffles 106' on its interior surface to capture droplets of oil or water and conduct them toward an oil recovery conduit 110'. The precise form of the purifier 14 or 14' is not critical to the invention.

The precooler 16', the system expander 18', the heat exchanger 22' and the mixer 26' of the portable system 10' are similar in construction and operation to the analogous components of the industrial system 10. Analogously to the industrial system 10 of FIG. 1, the precooler 16' includes a precooling heat exchanger 184' including a precooling heat exchange conduit 182' surrounded by a precooling heat exchanger shell 200'. A portion of the compressed air flow exiting the precooling heat exchanger 184' is tapped off and enters a precooling expander 186' comprising a series of needle expansion valves 188', 190' and 192' which expand that portion of the compressed air flow and direct that portion of the air flow into the precooling heat exchanger shell 200' for heat exchange with the remainder of the compressed air flow.

The system expander 18' comprises a series of expansion needle valves 210', 212' and 214' for expanding the compressed air flow. Such valves 210', 212' and 214', as well as the valves 188', 190' and 192' of the precooling expander 186', may be, for example, of the type exemplified by Haney valves or RS valves sold by Refrigeration Specialties. The invention is not limited the expanders 18, 186, 18' and 186' comprising expansion needle valves, but may be practiced with any known means for expanding and cooling a gas.

The structure of the heat exchangers 22 and 22' is not critical and may include, for example, plate units such as those commonly found in refrigerators or finned coil assemblies such as those currently used in air conditioners. Preferably, the heat exchangers 22 and 22' are of the type which restrain the refrigerated air flow passing through them so that the refrigerated air flow may be conducted back to the mixer 26 or 26'.

Various changes or modifications in the invention described may occur to those skilled in the art without departing from the true spirit or scope of the invention. The above description of preferred embodiments of the invention is intended to be illustrative and not limiting, and it is not intended that the invention be restricted thereto but that it be limited only by the true spirit and scope of the appended claims.

What is claimed is:

1. A pneumatic refrigeration system comprising:

a compressor for generating a pressure increase in an air flow;

a system expander downstream of the compressor for reducing a temperature of the air flow;

a precooler downdstream of the compressor and upstream of the system expander for cooling the air flow prior to expansion, wherein the precooler includes a precooling expander for expanding a portion of the air flow and a precooling heat exchanger for exchanging heat from a remainder of the air flow to that portion of the air flow; and a recycling conduit downstream of the system expander for conducting at least a part of the air flow toward the compressor.

2. A pneumatic refrigeration system comprising:

a compressor for forming a compressed air flow;

a system expander downstream of the compressor for forming a refrigerated air flow of reduced temperature relative to the compressed air flow;

a recycling conduit downstream of the system expander for conducting substantially all of the refrigerated air flow toward the compressor; and an accumulator having ports for receiving the refrigerated air flow from the system expander, supplying the refrigerated air flow to a cooling station, receiving the refrigerated air flow downstream from the cooling station, and exhausting the refrigerated air flow downstream from the cooling station to the recycling conduit.

3. A pneumatic refrigeration system comprising:

a compressor for forming a compressed air flow;

a system expander downstream of the compressor for forming a refrigerated air flow of reduced temperature relative to the compressed air flow a recycling conduit downstream of the system expander for conducting substantially all of the refrigerated air flow toward the compressor; and a mixer for receiving at least a part of the air flow from the recycling conduit, combining the at least a part of the air flow with a supply of ambient air sufficient to form a mixture having a preselected flow rate, and supplying the mixture to the compressor.

4. A method for refrigerating air comprising the steps of:

compressing the air in a compressor to form a compressed air flow;

expanding the compressed air flow to form a refrigerated air flow; and recycling at least a part of the refrigerated air flow to the compressor;

wherein the step of expanding the compressed air flow includes the steps of expanding a portion of the compressed air flow, exchanging heat between the portion of the compressed air flow and a remainder of the compressed air flow, and expanding the remainder of the compressed air flow to form the refigerated air flow.

5. A method for refrigerating air comprising the steps of:

compressing the air in a compressor to form a compressed air flow;

expanding the compressed air flow to form a refrigerated air flow;

accumulating the refrigerated air flow to bouyantly separate a first portion of the refrigerated air flow from a second portion of the refrigerated air flow;

circulating the first portion of the refrigerated air flow between the accumulator and a heat source; and recycling the second portion of the refrigerated air flow to the compressor.

6. A method for refrigerating air comprising the steps of:

compressing the air in a compressor to form a compressed air flow;

expanding the compressed air flow to form a refrigerated air flow;

combining the at least a part of the refrigerated air flow with a supply of ambient air sufficient to form a mixture having a preselected flow rate; and after combining the at least a part of the refrigerated air flow with the supply of ambient air, recycling at least a part of the refrigerated air flow to the compressor.

7. A method for cooling a refrigerant comprising the steps of:

compressing the refrigerant in a compressor;

expanding a first portion of the refrigerant;

exchanging heat between the first portion of the refrigerant and a second portion of the refrigerant;

expanding the second portion of the refrigerant, and recycling at least a part of the refrigerant to the compressor.

8. A pneumatic refrigeration system comprising:

a multistage compressor for generating a compressed air flow including first heat exchangers for cooling the compressed air flow between stages of the compressor;

a purifier for receiving the compressed air flow from the compressor and removing at least water vapor from the compressed air flow;

a precooler for receiving the compressed air flow from the purifier, wherein the precooler includes a precooling expander for expanding a portion of the compressed air flow and a precooling heat exchanger for exchanging heat from that portion of the compressed air flow to a remainder of the compressed air flow;

a system expander for receiving the compressed air flow from the precooler and expanding the remainder of the compressed air flow to generate a refrigerated air flow;

a output heat exchanger for receiving the refrigerated air flow from the system expander and exchanging heat with a heat source; and a mixer for receiving the refrigerated air flow from the output heat exchanger, mixing the refrigerated air flow with a supply of ambient air sufficient to form a mixture having a preselected flow rate, and discharging the mixture to the compressor.

9. A pneumatic refrigeration system comprising:

a compressor for generating a pressure increase in an air flow;

a system expander downstream of the compressor for reducing a temperature of the air flow; and a precooler downstream of the compressor and upstream of the system expander for cooling the air flow prior to expansion, wherein the precooler includes a precooling expander for expanding a portion of the air flow and a precooling heat exchanger for exchanging heat from a remainder of the air flow to that portion of the air flow.

* * * * *